United States Patent [19]

Nault

[11] 3,967,397

[45] July 6, 1976

[54] RAKE ATTACHMENT FOR BACK HOE AND THE LIKE

[76] Inventor: Harold Nault, 48 Beau St., Norwalk, Conn. 06880

[22] Filed: Feb. 6, 1975

[21] Appl. No.: 547,384

[52] U.S. Cl. ..... 37/117.5; 37/DIG. 3; 56/16.1; 214/79; 214/138 R

[51] Int. Cl.[2] ..... E02F 3/76

[58] Field of Search ..... 56/16.1, 365, 368; 37/DIG. 3, 117.5; 214/138 R, 79

[56] References Cited

UNITED STATES PATENTS

| | | | |
|---|---|---|---|
| 2,388,411 | 11/1945 | Hicks | 56/16.1 |
| 2,710,515 | 6/1955 | Johannesen | 56/16.1 X |
| 2,737,769 | 3/1956 | Donald | 56/16.1 X |

*Primary Examiner*—Louis G. Mancene
*Assistant Examiner*—J. N. Eskovitz

[57] ABSTRACT

A back hoe or tractor attachment for material handling apparatus. The attachment is used with a main frame and a swing frame pivotally mounted on said main frame for lateral and vertical swinging movement thereon. The attachment comprises a first member pivotally mounted on said swing frame; a rake is operatively mounted on said first member and a cable or chain is connected, on the one hand, to the free end of the first member and, on the other hand, to the swing frame, so that the first member is pivotally connected at one end to the swing frame and is suspended at the other end from the swing frame when the back hoe or tractor is in operation.

4 Claims, 4 Drawing Figures

FIG. 3
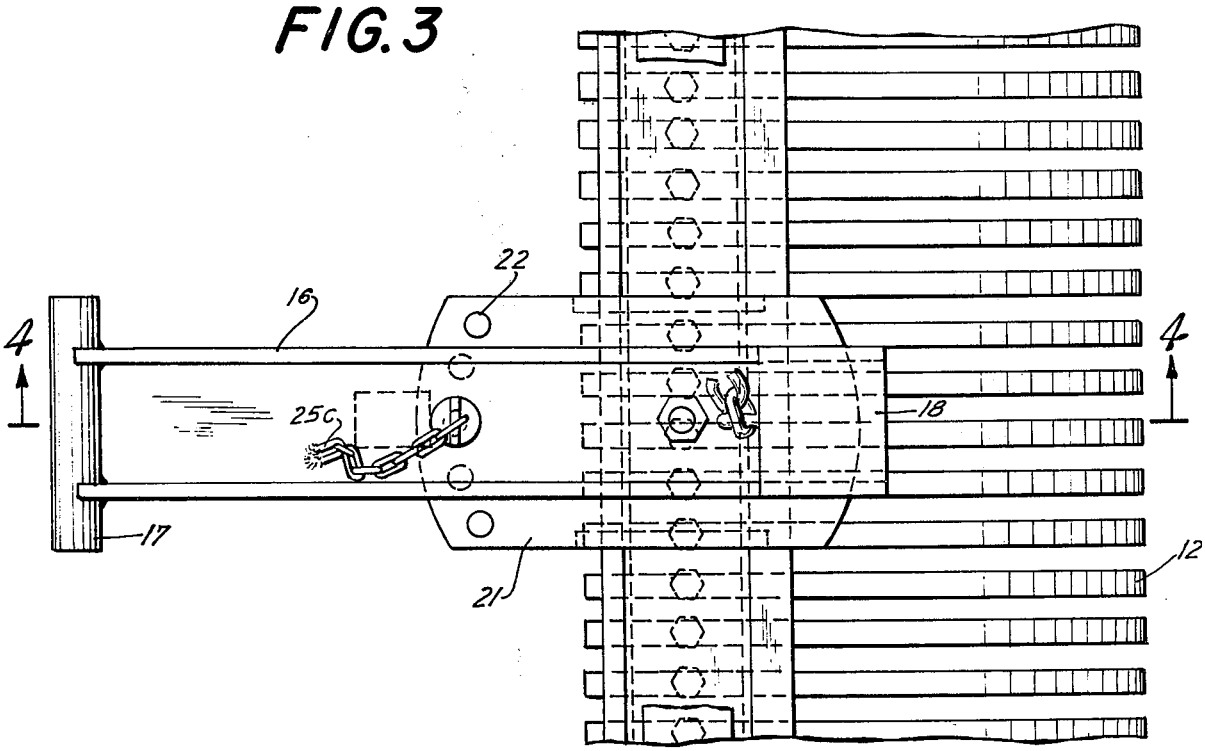
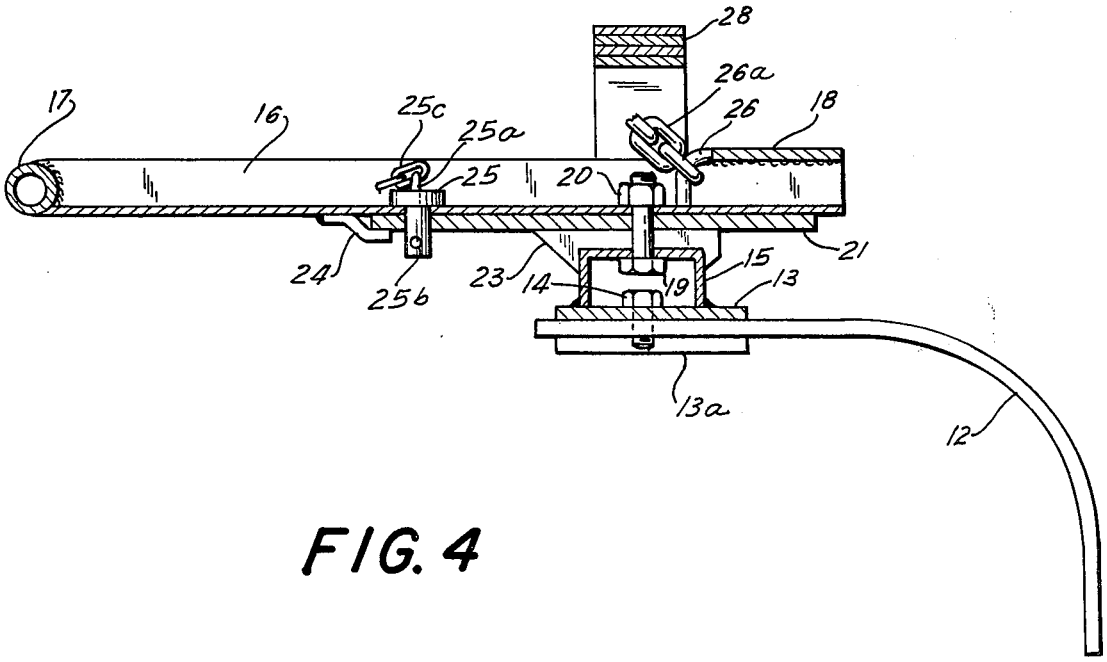
FIG. 4

RAKE ATTACHMENT FOR BACK HOE AND THE LIKE

BACKGROUND OF THE INVENTION

This invention relates to an attachment for material-handling apparatus, such as a back hoe or tractor. It is frequently necessary to rake the terrain which has been worked upon by utility blades, back hoes and other types of earth-moving equipment.

Such rakes are generally attached to material-handling equipment by means of a specially mounted boom, as for example, a boom as disclosed and described in U.S. Pat. No. 2,767,868. Such an attachment is generally referred to in the art as a "3-point hitch" or "3-point hook". This type of boom or crane forming part of the state of the art is costly and difficult to install. It generally must be mounted in the front of the tractor or back hoe and, in the event it is mounted in the rear of a back hoe, it is necessary to at least partially disassemble the back hoe members for purposes of mounting the 3-point hitch or hook.

SUMMARY OF THE INVENTION

It is a general object of the invention to provide a rake attachment which can easily be mounted on standard material-handling apparatus and in particular on a standard back hoe.

For this purpose, the rake attachment of the invention comprises a first member which is pivotally mounted to the vertically swingable boom of a back hoe, a rake is operatively mounted on the first member and the first member is suspended by means of a chain, cable or the like from either the vertically swingable boom of the standard back hoe or from the standard dipper stock or bucket of the back hoe.

DESCRIPTION OF THE DRAWINGS

The above and other features and advantages of the invention will be apparent from the following detailed description of the preferred embodiment taken in conjunction with the accompanying drawings, in which:

FIG. 3 is a partial top plan view of the rake attachment of the invention; and

FIG. 4 is a cross-sectional side elevational view of the embodiment taken along line 4—4 of FIG. 3.

DETAILED DESCRIPTION

Figure 1:
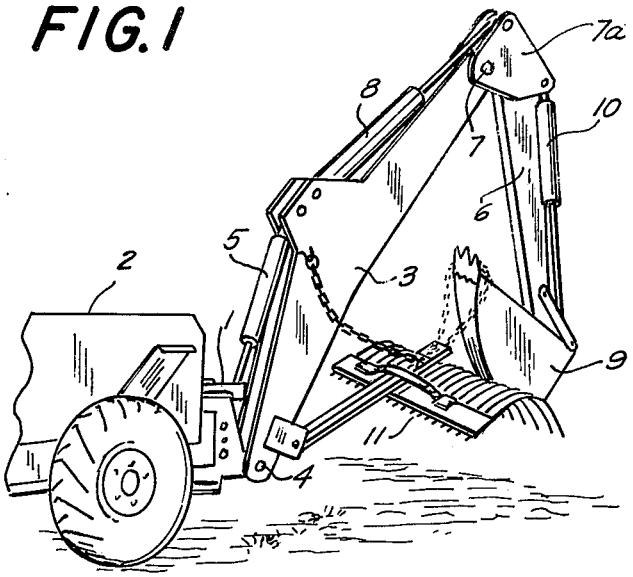
FIG. 1 is a perspective view of the rake attachment of the present invention as mounted on a standard back hoe.
Figure 2:
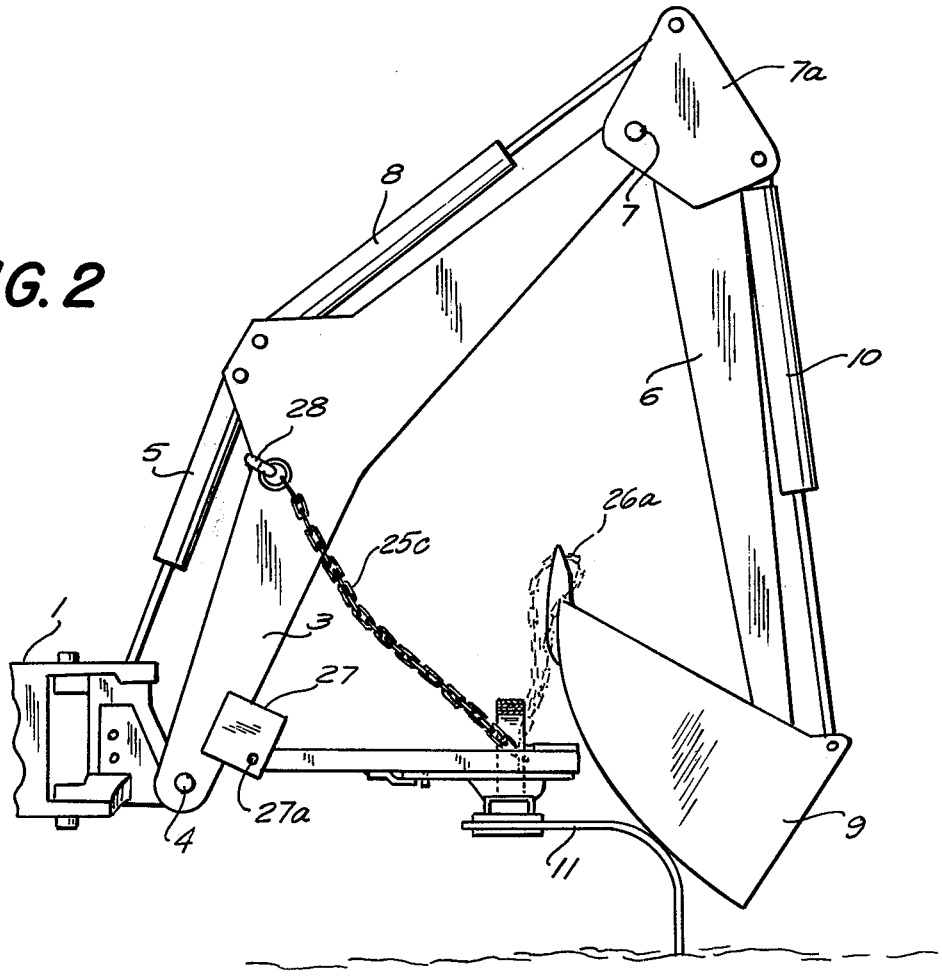
FIG. 2 is a side elevational view of the rake attachment of the invention shown in a larger scale than FIG. 1.

Referring to the drawings, in particular to FIGS. 1 and 2 thereof, the attachment of the invention is shown embodied in a back hoe for digging up and/or moving earth material. This back hoe includes the usual main frame 1 forming part of a tractor 2. The usual boom 3 is pivotally mounted at 4 on the main frame 1 and can be pivoted by means of the standard hydraulic cylinder and piston means 5 about the pivot pin 4. A dip stock 6 is pivotally mounted on the boom 3 by means of the usual pivot pin 7 and plate 7*a*. The dip stock can be pivoted about the boom 3 by means of a second standard hydraulic piston and cylinder actuating means 8. The bucket 9 is pivotally mounted (details are not shown) on the dip stock 6 and can be pivoted by means of standard hydraulic piston and cylinder actuating means 10. The standard hydraulic piston and cylinder actuating means 5, 8 and 10 are mounted in a conventional manner on the boom 3 and dip stock 6 as illustrated in FIGS. 1 and 2 and are instrumental in pivoting the boom 3, the dip stock 6 and the bucket 9, said boom 3 also being laterally swingable about the frame 1.

The attachment of the invention comprises a rake 11 having a plurality of curved pieces 12 which are mounted between a pair of support plates 13 and 13*a*, secured to each other by means of bolts 14. A channel 15 is welded to the back plate 13 as shown in FIG. 4. A second channel 16 has a pipe 17 welded at one end thereof as shown in FIGS. 3 and 4. A plate 18 is welded to the channel 16 at the free end thereof as shown in FIG. 4 for purposes of reinforcing the channel. The rake 11 is pivotally supported on the member formed by the channel 16, pipe 17 and reinforcing plate 18 as will be set forth hereinbelow: A plate 21 having a plurality of holes 22 disposed along an arc whose center is at the bolt 19, has a pair of lateral plates 23 welded thereon which are welded to the channel 15. The bolt 19 extends through mating holes in the channel 15, plate 21 and channel 16 and thus pivotally supports the entire rake assembly on the support member formed by the channel 16, pipe 17 and plate 18. A support bracket 24 is welded to the underside of the channel 16 and serves to additionally support the rake assembly via the plate 21. A holding pin 25, having a support ring 25*a* extends to a mating opening in the channel 16 and through one of the openings 22 in the plate 21, thereby fixing the angular position of the rake assembly with respect to the support member. A cotter or counter pin 25*b* serves to hold the pin 25 in position with respect to the rake assembly.

A hook 26 furthermore is welded onto the channel 16 as illustrated in FIG. 4. A chain 26*a* is connected to the hook 26 and a chain 25*c* is connected to the ring 25*a* of the pin 25.

A pair of plates 27 are welded at opposite lateral sides of the boom 3. The plates 27 have a pair of opposite openings through which a removable pin 27*a* extends.

It is possible to reinforce the rake assembly by having one or more leaf springs 28 welded onto the channel 15 as illustrated in FIG. 3.

MODE OF OPERATION AND ASSEMBLY

The rake attachment of the instant invention can be used with any type of back hoe or similar material-handling equipment by simply welding a pair of support plates 27 to opposite sides of the boom 3 and providing the plates 27 with mating opposite openings to accommodate a pin 27*a*. It is only necessary to remove the pin 27*a* and insert the pipe 17 between the plates 27 and then reinsert the pin 27*a*. The rake attachment of the invention is then pivotally supported on the boom 3 via the support member 16, 17, 18. The angular position of the rake assembly can be adjusted with respect to the boom 3 by removing the pin 25 and pivoting the rake assembly about the bolt 19 and then reinserting the pin 25 through one of the holes 22.

The rake attachment of the invention is suspended at its free end by means of the chain 26*a* which is preferably placed around the teeth of the bucket 9. The rake attachment of the invention can then be adjusted with respect to the tractor 2 by simply controlling its position via the bucket 9 through the conventional controls in the tractor 2. The rake attachment of the invention can also or additionally be supported by suspending the rake attachment from hooks 28 suitably welded onto the boom 3. The chain 25*c* which is connected to the pin 25 can also be suspended from one or more hooks 28.

It is possible, by adjusting the position of the bucket 9, to regulate the pressure with which the teeth 12 of the rake assembly 11 engage the ground surface by virtue of the fact that the back of the bucket 9 can be made to press onto the rake assembly 11 as it engages the ground surface.

Although the invention is illustrated and described with reference to a plurality of preferred embodiments thereof, it is to be expressly understood that it is in no way limited by the disclosure of such a plurality of embodiments, but is capable of numerous modifications within the scope of the appended claims.

What is claimed is:

1. A rake attachment for a back hoe having a main frame and a swing frame pivotally mounted on said main frame at one of its ends about a horizontal and a vertical axis, comprising in combination, a longitudinal first member adapted to be pivotally mounted at one of its ends on said swing frame;

a rake assembly operatively mounted on said first member distant from the pivotal connection between said first member and swing frame; and means connected to the first member adjacent to its other free end and to said swing frame;

whereby said free end of said first member and said rake assembly is suspended from said swing frame via said connecting means when said rake assembly is lifted by said swing frame.

2. The rake attachment as set forth in claim 1, wherein said connecting means are a chain.

3. The rake attachment as set forth in claim 1, wherein said rake assembly is adjustably mounted on said first member.

4. The rake attachment as set forth in claim 3, wherein said rake assembly has a first plate rigidly secured thereto, a first bolt extending through said first plate and being removably connected to said first member thereby adjustably supporting said rake assembly, said first plate being rotatable relative to said first member, said first plate having a plurality of holes disposed along an arc having its center at the axis of said first bolt, and a pin extending through said first member and into one of said plurality of holes for securing said rake assembly relative to said first member in a predetermined angular position.

* * * * *